United States Patent [19]

Lever et al.

[11] 4,060,068

[45] Nov. 29, 1977

[54] AIR COOLED FREESTANDING FIREPLACE

[75] Inventors: Paul H. Lever, Fallbrook; Clifford D. Mohr, Rancho, both of Calif.

[73] Assignee: Fireplace Corporation of America, Walled Lake, Mich.

[21] Appl. No.: 636,187

[22] Filed: Nov. 28, 1975

[51] Int. Cl.[2] ..... F24B 1/18

[52] U.S. Cl. ..... 126/120; 126/143

[58] Field of Search ..... 126/120, 121, 143

[56] References Cited

U.S. PATENT DOCUMENTS

| | | | |
|---|---|---|---|
| 3,538,909 | 11/1970 | Migues | 126/120 |
| 3,744,477 | 7/1973 | Andrews | 126/120 |
| 3,888,231 | 6/1975 | Galluzzo | 126/120 |

*Primary Examiner*—John J. Camby

*Assistant Examiner*—Larry I. Schwartz

*Attorney, Agent, or Firm*—Krass and Young

[57] ABSTRACT

A freestanding fireplace comprising a firebox and a spaced, outer housing has a primary draft to ventilate the firebox and secondary drafts to cool the firebox. The primary draft flows into the flue from the firebox through a conduit or pipe which fits within and is spaced radially from the flue. Secondary drafts flow through passages defined by the space between the firebox and the outer shelf and enter the flue around the outside of the primary draft pipe. The flow of the primary air draft creates a reduced pressure effect which draws air through the secondary draft passages, thereby cooling the firebox and the flue. Smoke spillage prevention means are also provided.

8 Claims, 6 Drawing Figures

AIR COOLED FREESTANDING FIREPLACE

INTRODUCTION

This invention relates to fireplaces of the freestanding metallic type, and more particularly to an air-cooled housing construction for such fireplaces.

BACKGROUND OF THE INVENTION

Conventional freestanding metallic fireplaces typically comprise a single wall cone or other shape within which fuel is burned. Primary air flows into the combustion area through the front opening of the fireplace, is heated by the combustion of the fuel, and flows upward through a metallic flue or chimney. Because the fireplace walls become heated by the combustion process, it is customary for building codes and similar regulations to call for a substantial spacing between the fireplace wall and adjacent combustible building material, such as wood paneling.

This limitation affects the efficient utilization of space in a room being heated by a freestanding fireplace. It would therefore be advantageous to provide a freestanding fireplace which has positive self-cooling means that allow it to operate at a reduced temperature. Accordingly, the fireplace may then be placed in closer proximity to building walls or other structural members in a room where space is limited.

It is also desirable to minimize leakage of smoke from a fireplace due to shifting of fireplace logs and other causes, such smoke leakage causes a disagreeable atmosphere in the room and stained ceilings and walls.

BRIEF SUMMARY OF THE INVENTION

The present invention provides a freestanding, metallic fireplace wherein exterior fireplace temperatures are reduced, thereby permitting the fireplace to be safely placed closer to combustible building materials such as paneling for interior walls. Thus, fireplaces built according to the invention may be used to great advantage where space is limited and/or where reduced exterior temperatures are desired.

In general, this is accomplished by constructing the fireplace so that a dynamic secondary air channel or passage exists between the outer walls of the firebox and the inner walls of the fireplace housing. Room air is inlet to the air passage through an opening in the housing and passes over the walls of a separate inner firebox and absorbs thermal energy before passing into the flue. The flow of air through this cooling passage is induced by the primary air flow from the firebox to the flue; i.e., the cooling air passage has an inlet for ambient room air and an outlet into the main flue. Primary air flow creates a pressure reduction at the outlet of the secondary air passage, thus inducing secondary air flow by the well known Venturi effect.

According to another feature of the invention, a secondary draft may be provided to minimize smoke spillage. This is accomplished by constructing a dynamic air channel or passage having an inlet between the hood and firebox and extending to an outlet in the main flue such that a primary air flow from firebox to flue induces air flow in the air channel by reason of pressure differential. By drawing in room air over the frontal opening of the firebox, the secondary draft tends to capture any smoke that would otherwise escape the primary draft and spill into the room.

In the preferred embodiment, the freestanding fireplace is constructed to accommodate both cooling and smoke capturing secondary drafts. Moreover, this is accomplished easily and inexpensively by constructing the main flue channel from the firebox in the form of a pipe which is radially smaller than, and coaxial within a larger pipe connected to the outer fireplace housing. The secondary air drafts are interconnected in a balanced relationship to outlet into the main flue by flowing around the firebox pipe; i.e., through the spacing between firebox pipe and outer housing pipe. The secondary air flow is induced by the reduced pressure in the main flue caused by relatively rapid flow of hot air from the firebox during normal fireplace use.

Other additions, modifications, and advantages of the present invention will be made apparent in the following description of a specific embodiment.

DETAILED DESCRIPTION OF THE SPECIFIC EMBODIMENT APPARATUS

Figure 1:
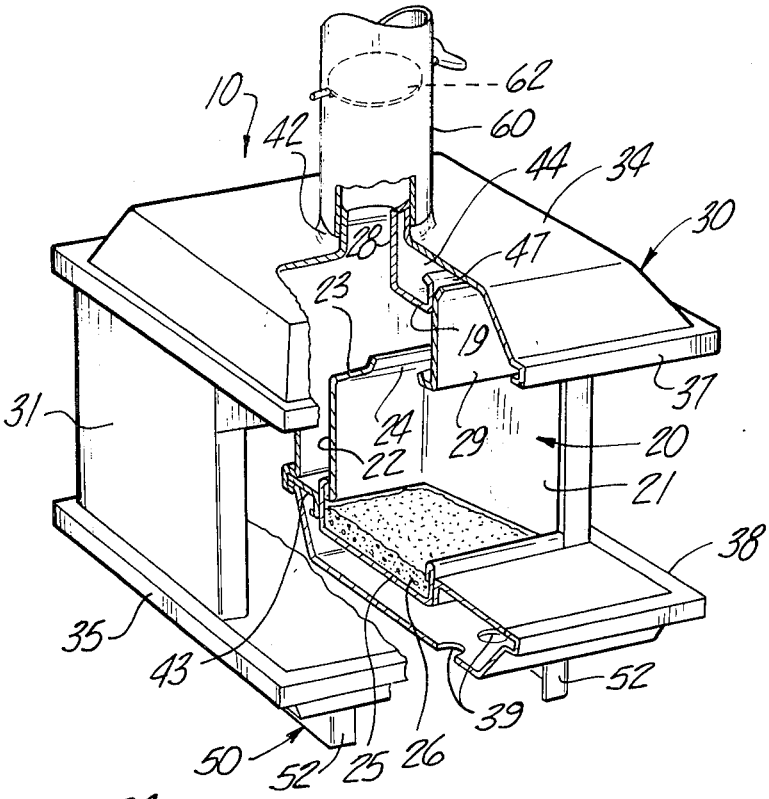
FIG. 1 is a perspective view, partially in section, of a freestanding metallic fireplace embodying the present invention.

Referring to the drawings, the invention is embodied in a freestanding metal fireplace 10 comprising an internal metal firebox 20 disposed within and spaced from an outer housing 30 which rests on a base 50. Fireplace 10 is ventilated, and, as hereinafter described, cooled by a flue 60 which carries combustion products away from the firebox in the conventional way; i.e., the heated combustion products flow upwardly into flue 60 to create a primary air flow. A damper 62 is located in flue 60 to control air flow. Firebox 20 and housing 30 are preferably constructed from aluminized steel.

Firebox 20 is formed to have a generally solid rectangular shape. It includes sidewalls 21, rear wall 22, front wall 29, top 18, and floor 25. The front wall 29 of the firebox 20 is abbreviated to define a large frontal opening 27 through which combustible materials, such as wood, may be introduced into the combustion area.

The top 18 has a central aperture 17 formed therein. Extending from the aperture 17 and secured to top 18 is a primary ventilation pipe 28 which communicates firebox 20 with the flue 60. The ventilating pipe 28, for reasons which will be hereinafter made apparent, has a cross-section area smaller than that of the flue 60, preferably on the order of 1.3:1, allowing it to be radially spaced within the flue 60. The front terminal portion of ceiling 18 is turned upwardly from the seam with front wall 29 to define an air baffle 47.

The internal structure of the firebox 20 includes a rear reflecting wall 19 and a conventional smoke shelf 23 extending forwardly from the wall 19 at an acute upward angle to provide downdraft protection. The passage between a forward edge of the smoke shelf 23 and the front wall 29 defines a throat 24, through which combustion products pass as they ascend toward the flue. A fire base 26, which may be formed from fire brick or some other cast, aggregate composition able to withstand the heat of combustion, is supported by the firebox floor 25.

The firebox 20 is covered on all of its closed sides by the housing 30 which includes sidewalls 31, rear wall 32, top section 34, and bottom section 35. The housing 30 has a frontal opening 33 in operative registry with the frontal opening 27 of the firebox 20. The housing 30 rests on a base 50 which comprises two, long longitudinal members 52 and a cross-tying member 54.

The top section 34 of the housing 30 has a flue opening 45 in operative registry with the flue opening 17 of the firebox 20. A flange 42 extends upwardly from the periphery of the housing flue opening 45 and is dimensioned to be closely received within the flue 60.

Figure 2:
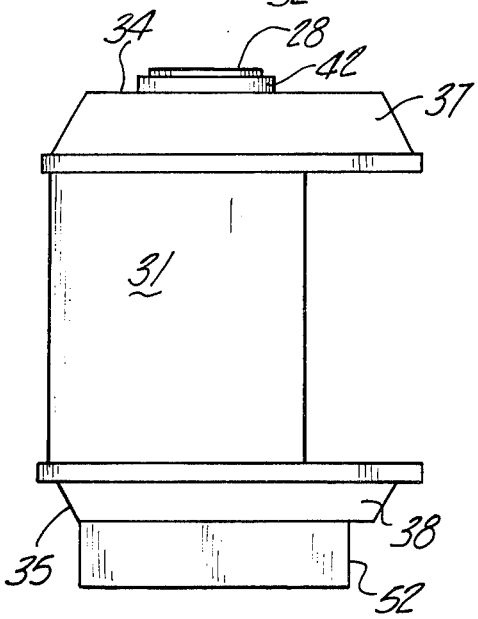
FIG. 2 is a side elevational view further illustrating the external features of the freestanding fireplace of FIG. 1.

As best seen in FIG. 2, the top section 34 of the housing 30 extends forwardly of the firebox 20 to define a hood 37. Similarly, the bottom section 35 extends forwardly of the firebox 20 to define a hearth 38.

Figure 3:
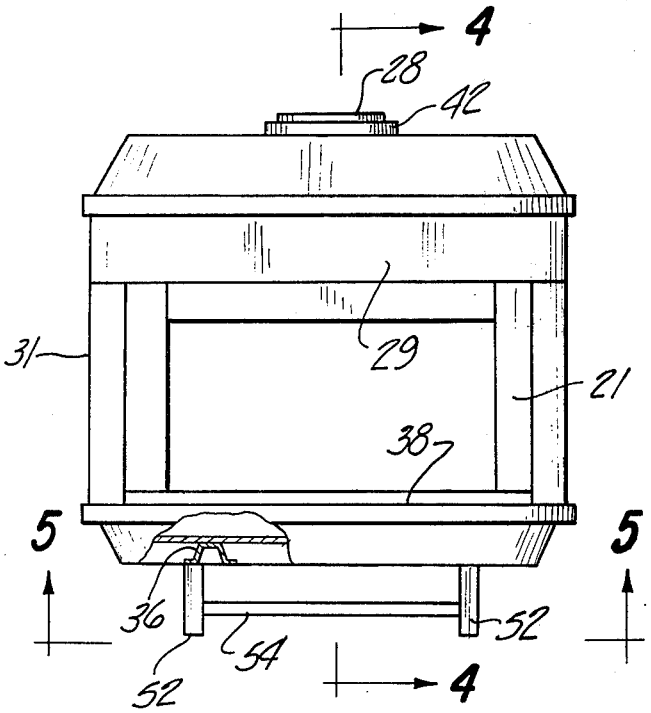
FIG. 3 is a front, elevational view, partially in section, of the freestanding fireplace of FIG. 1, particularly showing the means by which the firebox is supported within the housing.
Figure 4:
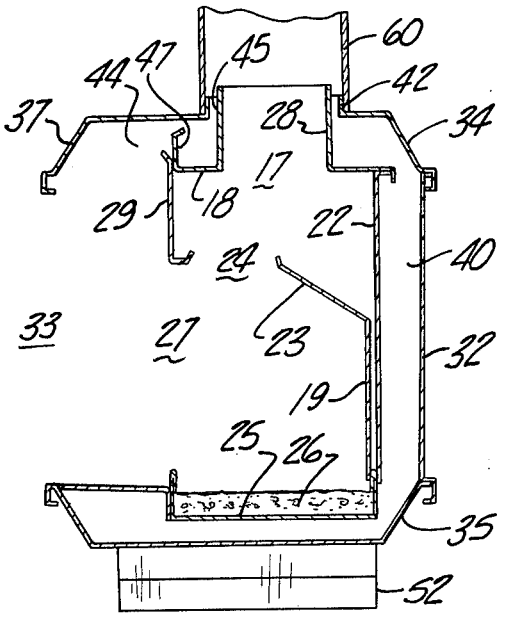
FIG. 4 is a side sectional view taken along line 4—4 of FIG. 3 showing the internal structure of the fireplace of FIG. 1.

The firebox 20 has a spaced relationship with the housing 30. As illustrated in FIG. 3, the floor 25 of the firebox 20 is kept in spaced relation with the bottom section 35 of the housing 30 by a plurality of rigid, elongate support members 36 commonly known as "hat sections". The support members 36 are spaced from one another and extend perpendicularly with respect to the frontal opening 27 of the firebox 20. As best illustrated in FIG. 1, the rear wall 22 of the firebox 20 is kept in spaced relation with the rear wall 32 of the housing 30 by a plurality of discrete spacers 43 which are tied between rear walls 22 and 32 of the firebox and housing, respectively.

Figure 5:
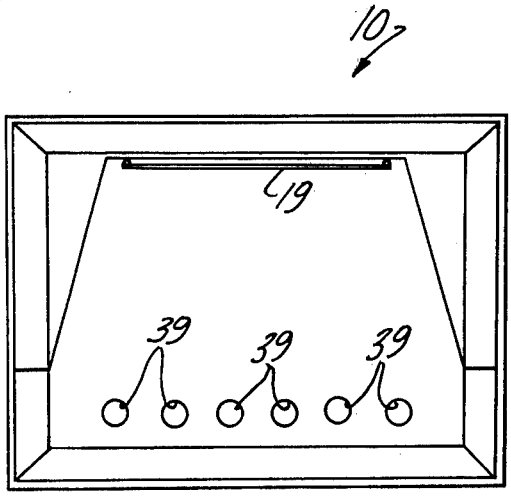
FIG. 5 is a bottom sectional view taken along line 5—5 of FIG. 3 illustrating the air intake apertures on the underside of the hearth; and, FIG. 6 is an enlarged view of the flue details indicating the manner in which the Venturi effect is created.
Figure 6:
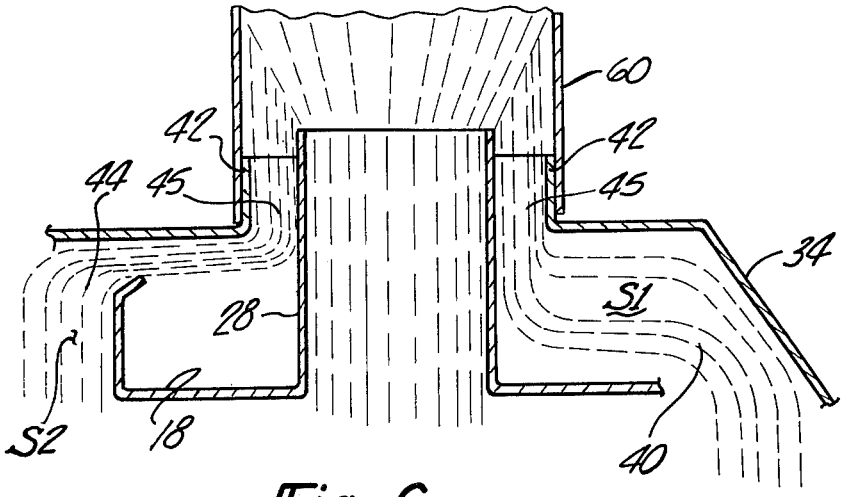

The spaced relationship between firebox 20 and housing 30 creates a dynamic secondary air channel or passage 40 between the exterior of the firebox and interior of the housing. The air passage 40 has an inlet in communication with the room through a plurality of apertures 39 which are shown in FIG. 5 as being formed in the underside of the hearth 38. The outlet of the air passage 40 is the radial space between primary ventilating pipe 28 and flange 42. Accordingly, the secondary air flow is from the ambient room air to the flue 60, such flow being induced by the reduced pressure in flue 60 which results from the flow of primary air as previously described.

Additionally, in the preferred embodiment shown herein, a second dynamic air channel or passage 44 exists between the firebox top 18 and the top section 34 of the housing 30. The second dynamic air channel 44 has an inlet adjacent the underside of the hood 37, and an outlet at the radial space between primary ventilating pipe 28 and flange 42. Thus, secondary air flow is induced in this channel by the same fluid mechanics which cause secondary air to flow in channel 40.

OPERATION

For purposes of discussion, it is assumed that combustion exists within the firebox 20 of sufficient temperature to create and sustain a primary draft through the flue 60.

In operation, the firebox 20 is ventilated by a primary draft, P, which enters the flue 60 from the primary ventilating pipe 28. The existence of the primary draft P then tends to induce secondary drafts S1 and S2 through the first and second dynamic air passages, respectively, by Venturi effect.

Secondary draft S1 occurs when air in the first, dynamic air passage 40 is warmed by thermal radiation from the firebox 20 and starts to rise through flue 60. The pressure drop resulting from flow into the flue 60 induces a corresponding flow from the room into the dynamic air passages 40 and 44.

The secondary draft S1 passing over the outside walls of the firebox 20 cools the firebox and the housing 30. Since the temperature of secondary draft S1 is still relatively cooler than the primary draft P, it contributes toward an overall reduction in the temperature of the flue 60 as well.

Secondary draft S2 occurs in a manner similar to secondary draft S1. The corresponding flow from the room is through the underside of the hood 37. Secondary draft S2 serves to capture any smoke which may have escaped the primary draft P and spilled from the firebox. Additionally, it contributes to the cooling of the firebox 20 and flue 60 in the same manner as secondary draft S1.

As will be apparent to practitioners in the art, the strengths of secondary drafts S1 and S2 are balanced in varying embodiments of the invention by modifying the size of either baffle 47 or apertures 39 or both.

SUMMARY

A fireplace embodying the present invention provides several important advantages over prior art designs. First, the fireplace is air cooled to achieve a lower exterior temperature. This allows the fireplace to be placed in closer proximity to building walls. Second, it has positive means for capturing smoke spillage. Third, both cooling and smoke caputre are accomplished by way of a simple, inexpensive, but highly effective flue arrangement.

The foregoing description is not intended to be limiting, as one with skill in the art will see that the invention may be embodied in a fireplace having either one or both of the two secondary drafts. Many other arrangements will be apparent and may be used without departing from the scope or spirit of the present invention.

The embodiments of the invention in which an exclusive property or privilege is claimed are defined as follows:

1. A fireplace unit comprising: an outer housing having a rear wall, a top, bottom and side walls and a frontal opening;

a flue connected to an opening in said outer housing;

a firebox disposed within said outerhousing, an opening corresponding to said outer housing frontal opening and having a floor for supporting a hearth;

said firebox also including bottom, sides and rear wall at least some of said walls or floor being supported in spaced apart relationship to said outer housing bottom, sides, or top to define air passages therebetween;

means for creating primary air flow through said firebox for supporting combustion therein, said means including a pipe connecting said firebox with said flue, said pipe being of smaller cross-sectional area than said flue and extending into said flue so as to define a clearance space therebetween and also defining a sudden enlargement in the flow path through which said primary air flows;

means for creating a secondary air flow through said air passages, said means including air inlets in communication with said air passages and also including means creating a fluid connection between said air passages and said clearance space between said pipe and said flue, whereby relatively low pressure created in said clearance space by flow of primary air into said sudden enlargement induces flow through said air passages.

2. The fireplace unit according to claim 1 wherein said relationship between said flue and said pipe cross sectional areas is 1.3:1.

3. The fireplace unit according to claim 1 wherein said air inlets comprise openings in said outer housing bottom.

4. The fireplace unit according to claim 1 wherein said outer housing and said firebox are formed of metal.

5. A fireplace unit comprising: an outer housing having a rear wall, a top, bottom and side walls and a frontal opening;

a flue connected to an opening in said outer housing;

a firebox disposed within said outer housing, an opening corresponding to said outer housing frontal opening and having a floor for supporting a hearth;

said firebox also including bottom, sides and rear wall at least some of said walls or floor being supported in spaced apart relationship to said outer housing bottom, sides, or top to define air passages therebetween;

means for creating primary air flow through said firebox for supporting combustion therein, said means including a pipe connecting said firebox with said flue, said pipe being of smaller cross-sectional area than said flue and extending into said flue so as to define a clearance space therebetween;

means for creating a secondary air flow through said air passages, said means including air inlets in communication with said air passages and also including means creating a fluid connection between said air passages and said clearance space between said pipe and said flue, whereby relatively low pressure created in said clearance space by flow of primary air into said flue induces flow through said air passages; and wherein said firebox includes a frontal wall above said firebox opening, the outer housing top includes a housing and lower edge extending opposite said firebox, said firebox frontal wall, a hood extending forwardly of said firebox, and further includes means creating airflow into said space between said outer housing hood and said firebox frontal wall into said flue, said means including a fluid connection between said space and said clearance space between said pipe and said flue whereby air is drawn through said space by the flow of the primary air in said flue to capture any smoke spillage from said firebox.

6. The fireplace unit according to claim 1 wherein said pipe is coaxial with said flue.

7. The fireplace unit according to claim 6 wherein pipe and said flue are circular in cross-section.

8. The fireplace unit according to claim 7 wherein said relationship between said flue and said pipe cross-sectional areas is 1.3:1.

* * * * *